US012377336B2

(12) United States Patent
Schloss et al.

(10) Patent No.: US 12,377,336 B2
(45) Date of Patent: Aug. 5, 2025

(54) ROD AND HEAD ASSEMBLY FOR A TENNIS BALL TRAINING SYSTEM

(71) Applicants: Lenny Schloss, Charleston, SC (US); Lee Wheelbarger, Fulks Run, VA (US); Robert Cantrell, Herndon, VA (US)

(72) Inventors: Lenny Schloss, Charleston, SC (US); Lee Wheelbarger, Fulks Run, VA (US); Robert Cantrell, Herndon, VA (US)

( * ) Notice: Subject to any disclaimer, the term of this patent is extended or adjusted under 35 U.S.C. 154(b) by 70 days.

(21) Appl. No.: 17/588,332

(22) Filed: Jan. 30, 2022

(65) Prior Publication Data

US 2024/0216778 A1 Jul. 4, 2024

(51) Int. Cl.
*A63B 69/38* (2006.01)

(52) U.S. Cl.
CPC ..... *A63B 69/38* (2013.01)

(58) Field of Classification Search
CPC ..... A63B 69/38
See application file for complete search history.

(56) References Cited

U.S. PATENT DOCUMENTS

| | | | | | |
|---|---|---|---|---|---|
| 3,876,203 | A * | 4/1975 | Gold | A63B 69/0091 | 473/417 |
| 5,685,542 | A * | 11/1997 | Weis | A63B 69/0091 | 588/1 |
| 10,065,099 | B2 * | 9/2018 | Dagn | A63B 43/008 | |
| 2013/0053188 | A1 * | 2/2013 | Moore | A63B 69/38 | 473/423 |
| 2013/0196794 | A1 * | 8/2013 | Wheelbarger | A63F 13/245 | 473/422 |
| 2015/0209644 | A1 * | 7/2015 | Verma | A63B 69/0075 | 473/419 |
| 2022/0288457 | A1 * | 9/2022 | Schloss | A63F 13/212 | |

FOREIGN PATENT DOCUMENTS

| | | | | |
|---|---|---|---|---|
| CN | 114504792 | A * | 5/2022 | |
| DE | 202014103293 | U1 * | 2/2015 | A63B 43/008 |
| DE | 202016105816 | U1 * | 3/2017 | A63B 43/002 |
| GB | 2522427 | A * | 7/2015 | A63B 43/007 |
| WO | WO-2011056055 | A2 * | 5/2011 | A63B 69/38 |
| WO | WO-2020100137 | A1 * | 5/2020 | A63B 24/0062 |
| WO | WO-2021232107 | A1 * | 11/2021 | A63B 43/007 |

* cited by examiner

*Primary Examiner* — Raleigh W Chiu
(74) *Attorney, Agent, or Firm* — Robert Cantrell; Jose W. Jimenez; Jimenez Law Firm

(57) ABSTRACT

A training tool for tennis has a head assembly, a stand assembly, and a vertical polymer flexible rod assembly connecting the substantially polymer head assembly to the stand assembly. The vertical polymer flexible rod assembly oscillates when a ball member held in the head assembly is hit by a racket. The system is operably coupled to sensors and a processor designed to detect how effectively a user has hit the retained ball member with a racket. The head assembly is disposed on a top end of the vertical polymer flexible rod assembly at a concave portion of a proximal face of a retaining plate member designed to contiguously abut at least a distal surface of the top end of the vertical polymer flexible rod assembly, the retaining plate member coupled to a distal surface of a ball cup member by the proximal face of the retaining plate member.

20 Claims, 15 Drawing Sheets

ROD AND HEAD ASSEMBLY FOR A TENNIS BALL TRAINING SYSTEM

CLAIM OF PRIORITY

This application claims priority to and the benefit of U.S. Provisional application with Ser. No. 63/143,945, filed on Jan. 31, 2021, with the same title, which is incorporated herein by reference in its entirety.

FIELD OF THE INVENTION

The inventive concept relates generally to a rod and head assembly for a tennis ball training system.

BACKGROUND

Currently, there are many ways to teach tennis players to properly hit a ball. One of these ways is with a coach, but this solution fails to meet the needs of the market because coaching can be expensive and may require a second person to hit or otherwise present balls to be hit by a player. A coach or player may use a machine to launch balls, but such a solution also fails to meet the needs of the market because such machines can be expensive and cumbersome, require many tennis balls for a training session, and the coach and player may spend time collecting hit balls that could otherwise be time used for training. Both coaches and ball launching machines also require a court to be effective and are not suitable for use in the home or other restricted areas. Stationary solutions where a tennis ball or its likeness are presented to a player solve some of the above problems, especially those pertaining to training in a critical zone of how a player handles a ball substantially within the last three feet of ball travel, but such solutions offer limited feedback to coaches or players about the effectiveness of hits, especially at those times when a player may wish to practice without a coach being present. Stationary solutions also lack an optimal balance between durability and desirable performance qualities desired to emulate hitting an airborne ball. Therefore, there exists a need in the market for an improved solution for a stationary tennis ball trainer.

SUMMARY OF THE INVENTION

The first element of the inventive concept is a head assembly for a tennis ball training system that has a polymer ball cup member with a substantially concave proximal face portion and a rim portion assembly. The concave proximal face portion is designed to be coupled to a ball member by the rim portion assembly of the concave proximal face portion, substantially the entirety of the concave proximal face portion supporting and contiguously abutting a first surface portion of the ball member. The rim portion assembly is comprised of at least one removable, helically threaded retaining ring member coupled to a proximal, helically threaded lip portion of the ball cup member. An interior surface of the retaining ring member is substantially contiguously abutting a second surface portion of the ball member, the sum of the first and second surface portions of the ball member greater than fifty percent of a total surface area of the ball member. At least one optical sensor assembly is outwardly disposed along the concave proximal face portion of the ball cup member. At least one light-emitting diode (LED) member and at least one light detecting photodiode member is designed to detect a spin force from the first ball surface portion when a racket impacts the ball member. A metallic or polymer textured surface or color patterned surface or both may be disposed on the first ball surface portion to aid in spin detection. At least one three-axis impact sensor assembly is disposed in an interior portion of the ball cup member designed to detect trajectory forces imparted on the ball member when the racket impacts the ball member. A distal surface of the ball cup member opposite the rim portion assembly is coupled by at least one helically threaded attachment member to a substantially vertical polymer flexible rod assembly, the vertical polymer flexible rod assembly bearing at least one flex sensor assembly designed to detect bending of the polymer flexible rod assembly. At least one LED light member is disposed on a top portion of the ball cup member and designed to emit at least one light color in one or more defined patterns. At least one electrical coupling member is disposed on the distal surface of the ball cup member electrically coupled to the at least one optical sensor assembly, the at least one three-axis impact sensor assembly, and the at least one LED light member. The at least one optical sensor assembly, the at least one three-axis impact sensor assembly, and the at least one flex sensor assembly are electrically coupled to a computer system, the computer system having a controller through which the computer system calculates and communicates results from the sensor data by way of at least one algorithm or memory enabled program.

The second element of the inventive concept coupled to the first element includes a bendable shaft assembly for a head assembly of a tennis ball training system that has a vertical polymer flexible rod assembly coupled at a top end of the vertical polymer flexible rod assembly to a distal surface of the ball cup member by a retaining plate member. The retaining plate member has a concave portion on a proximal face of the retaining plate member designed, when coupled to the distal surface of the ball cup member, to secure the head assembly to the top end of the vertical polymer flexible rod assembly. The retaining plate member is coupled to a distal surface of a ball cup member by the proximal face of the retaining plate member. At least one flex sensor assembly is designed to detect bending of the polymer flexible rod assembly. A ribbon wire member is disposed longitudinally along the length of the vertical polymer flexible rod assembly and a metal base plate member. The ribbon wire member is electrically coupled to a power source by a bottom portion of the ribbon wire member. A top portion of the ribbon wire member is coupled to an electrical coupling member on a distal surface of the ball cup member, the top portion of the ribbon wire member disposed to substantially abut the proximal face of the retaining plate member. A top portion of the metal base plate member is couple by two or more helically threaded attachment members—the helically threaded attachment members disposed through two or more hole members disposed through the metal base plate member—to the vertical polymer flexible rod assembly and a back plate member, the helically threaded attachment members disposed through one or more attachment hole members disposed through a bottom portion of the vertical polymer flexible rod assembly and coupled to a corresponding two or more threaded hole members of the back plate member, an upper portion of the vertical flexible polymer rod member designed to oscillate from racket impact energy imparted on the ball cup member. At least one base hole member on a bottom portion of the base plate member is designed to be aligned with at least one pin member and attachment hole member of a substantially hollow vertical sleave member of a stand assembly.

The inventive concept may be used for other racket sports such as racket ball and pickle ball.

The inventive concept in one embodiment uses a PATTSS flow that would be utilized within the computer system to train a student. PATTSS stands for (Power, Accuracy, Timing, Trajectory, Spin, Sweet spot.). Power is the energy delivered to a ball. Accuracy is where the player places the ball. Timing is when the player hits the ball. Trajectory is how the ball travels. Spin is the rotation the player imparts on the ball. Sweet spot is the place of impact on the racket where impact is sought to take place substantially in the center of the racket face. Additional sensors beyond those disclosed for this embodiment such as load cells may be applied to determine sweet spot, or statistical assessments may be considered based on the probability that certain results will be achieved through results obtained from the other PATTSS categories, for example, that a ball is statistically likely to behave in a desired way after a hit if the ball is consistently hit in the sweet spot. The data obtained from these sensors may have a broader range of uses beyond reporting a performance score such as to provide the statistical data needed for using the inventive concept with virtual reality or augmented reality systems. A person wearing eyewear for virtual reality or augmented reality such as goggles, glasses, or contact lenses, may see the virtual flight of a ball incoming before a hit on the ball member or outgoing after a hit on the ball member.

The inventive concept now will be described more fully hereinafter with reference to the accompanying drawings, which are intended to be read in conjunction with both this summary, the detailed description and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete, and will fully convey the full scope of the inventive concept to those skilled in the art.

DETAILED DESCRIPTION OF THE INVENTION

Following are more detailed descriptions of various related concepts related to, and embodiments of, s and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Figure 1:
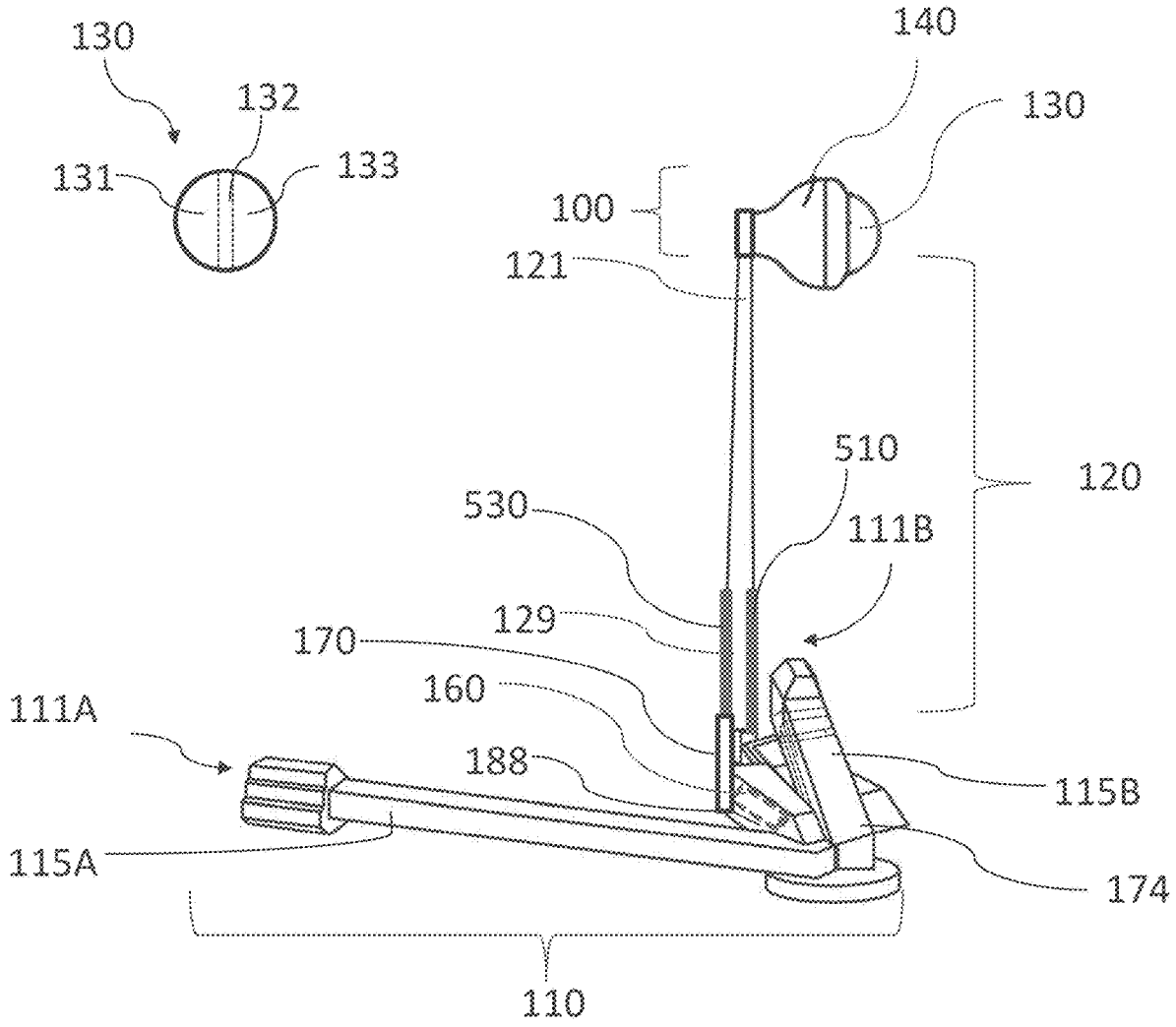
FIG. 1 illustrates a rod and head assembly for a tennis ball training system.
Figure 3:
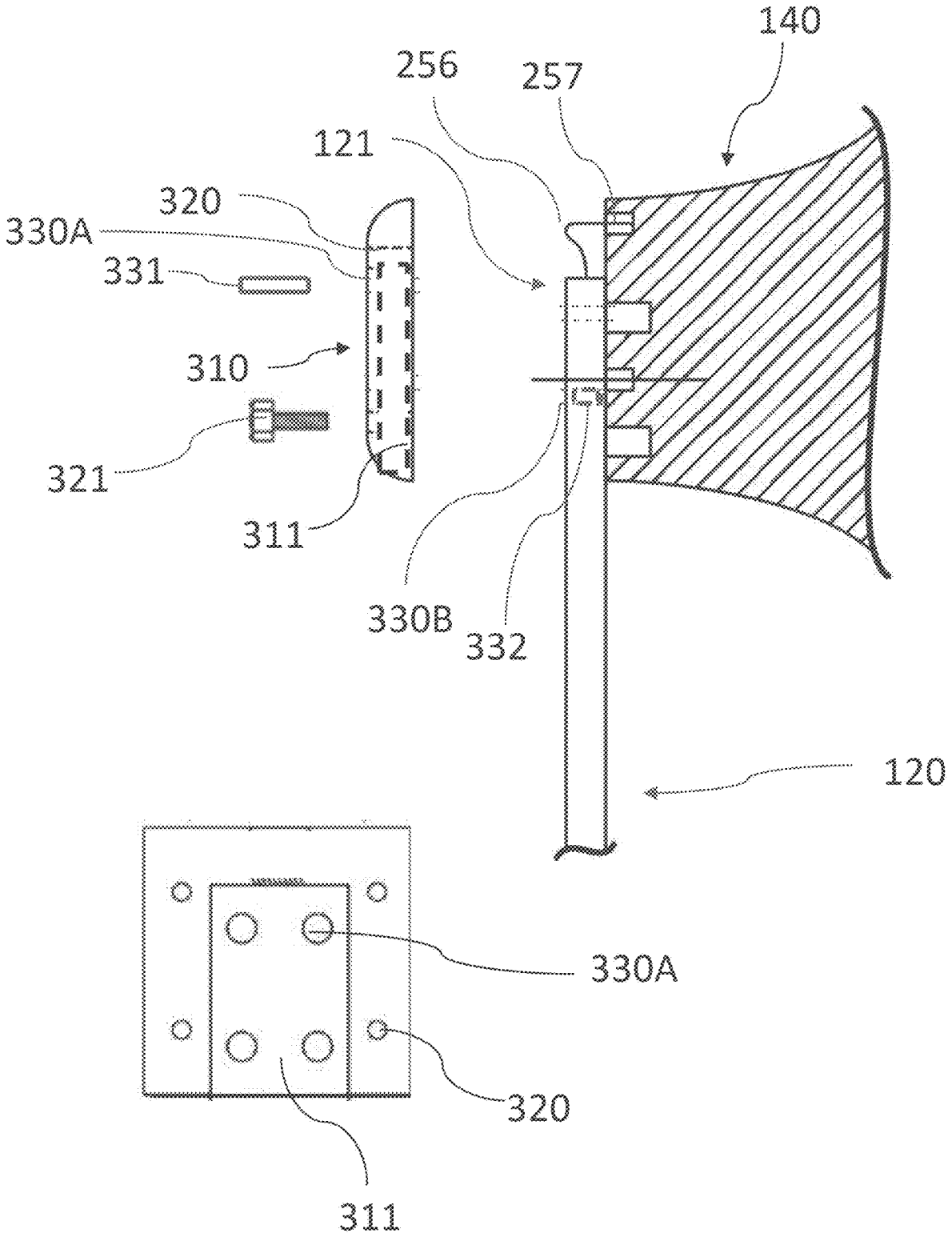
FIG. 3 illustrates a retaining plate member of the rod and head assembly for a tennis ball training system.

Referring to the figures, FIG. 1 illustrates three components of the inventive concept: 1) a head assembly 100, 2) a stand assembly 110, and 3) a vertical polymer flexible rod assembly 120 connecting the head assembly 100 to the stand assembly 110, the vertical polymer flexible rod assembly 120 also providing important functions for using the solution. Important is the oscillating of the flexible rod assembly 120 after a user hits a ball member 130 held by a polymer ball cup member 140 of the head assembly 100. The inventive concept allows a user to know how effectively he or she hit the ball member 130 with a racket even though the ball member 130 is retained in the head on a top end of the vertical polymer flexible rod assembly 121. With reference to FIG. 3, a concave portion on a proximal face of the retaining plate member 311 is designed, when coupled to a distal surface of the ball cup member 149, to circumscribe the top end of the vertical polymer flexible rod assembly 121, coupling the head assembly 100 to the top end of the vertical polymer flexible rod assembly 121.

Figure 2:
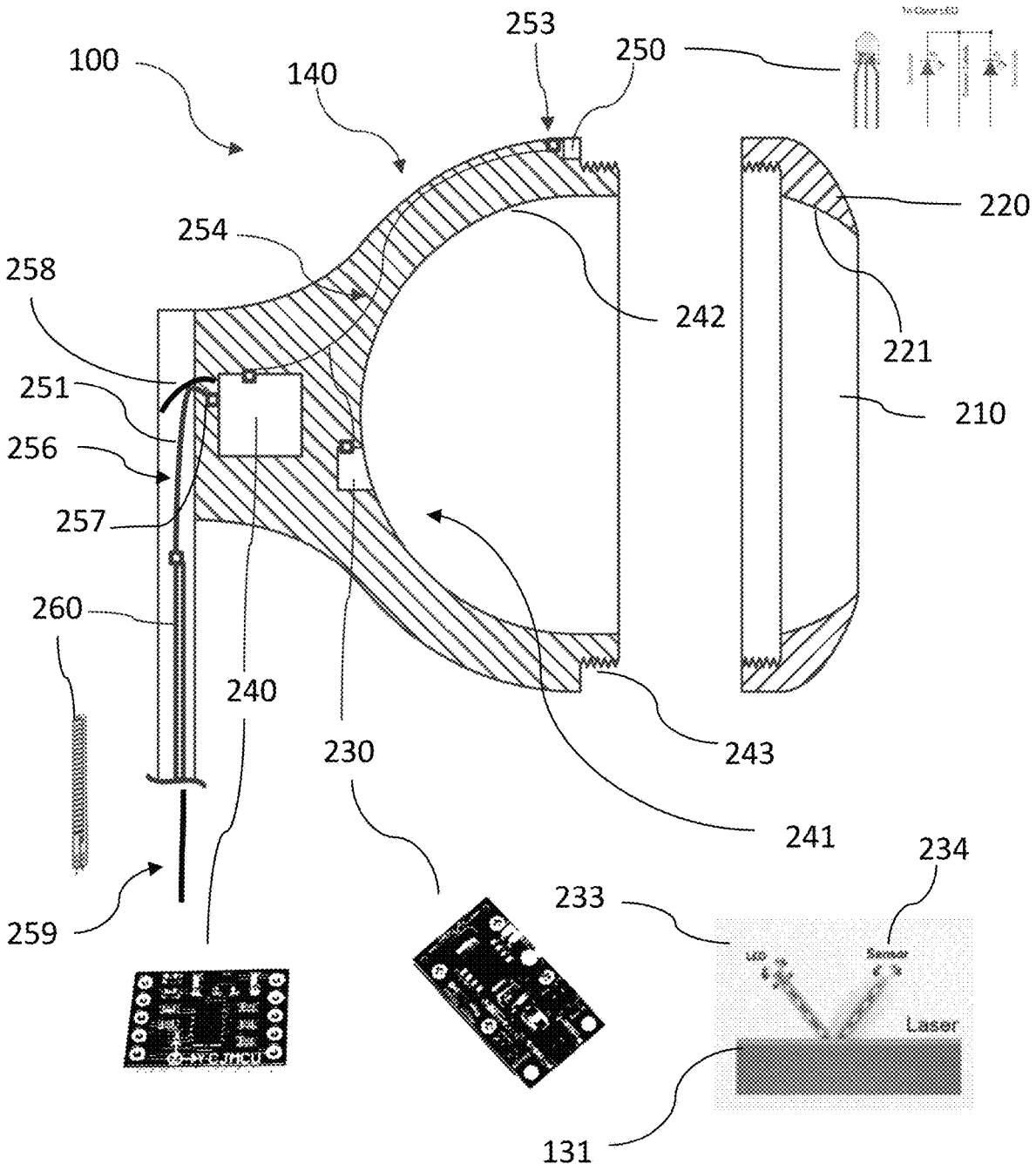
FIG. 2 illustrates a head assembly of the rod and head assembly for a tennis ball training system.

FIGS. 1 and 2 illustrate the head assembly 100, including a ball cup member 140 that is a substantially spherical, concave proximal face portion of the ball cup member 241 designed to contain approximately 60% of the ball member 130, with a surface of the concave proximal face portion of the ball cup member 242 being disposed substantially contiguous with a first surface portion of the ball member 131. In this example embodiment, the retaining ring member hole 210 is 15% smaller than the ball member 130 and is defined by a helically threaded retaining ring member 220 affixed to a helically threaded proximal lip portion of the ball cup member 243. An interior surface of the retaining ring member 221 being substantially contiguously abutting a second surface portion of the ball member 132, the sum of the first and second surface portions 131, 132 being greater than fifty percent of a total surface area of the ball member 130. The retaining ring member 220 in the example embodiment allows the approximately 60% of the ball member 130 to be inserted substantially within the ball cup member 140 and secured there. At least greater than 50% of the ball member 130 in all embodiments would be contained by the ball cup member 140. The user strikes the ball member 130 on an exposed 40% to 49% of the ball member 130, representing a third surface area of the ball member 133. The ball cup member 140 is made from a high-impact polycarbonate that can withstand the impact of a tennis racket, both the strings and the metal, carbon composite, or wood of the frame.

Figure 8:
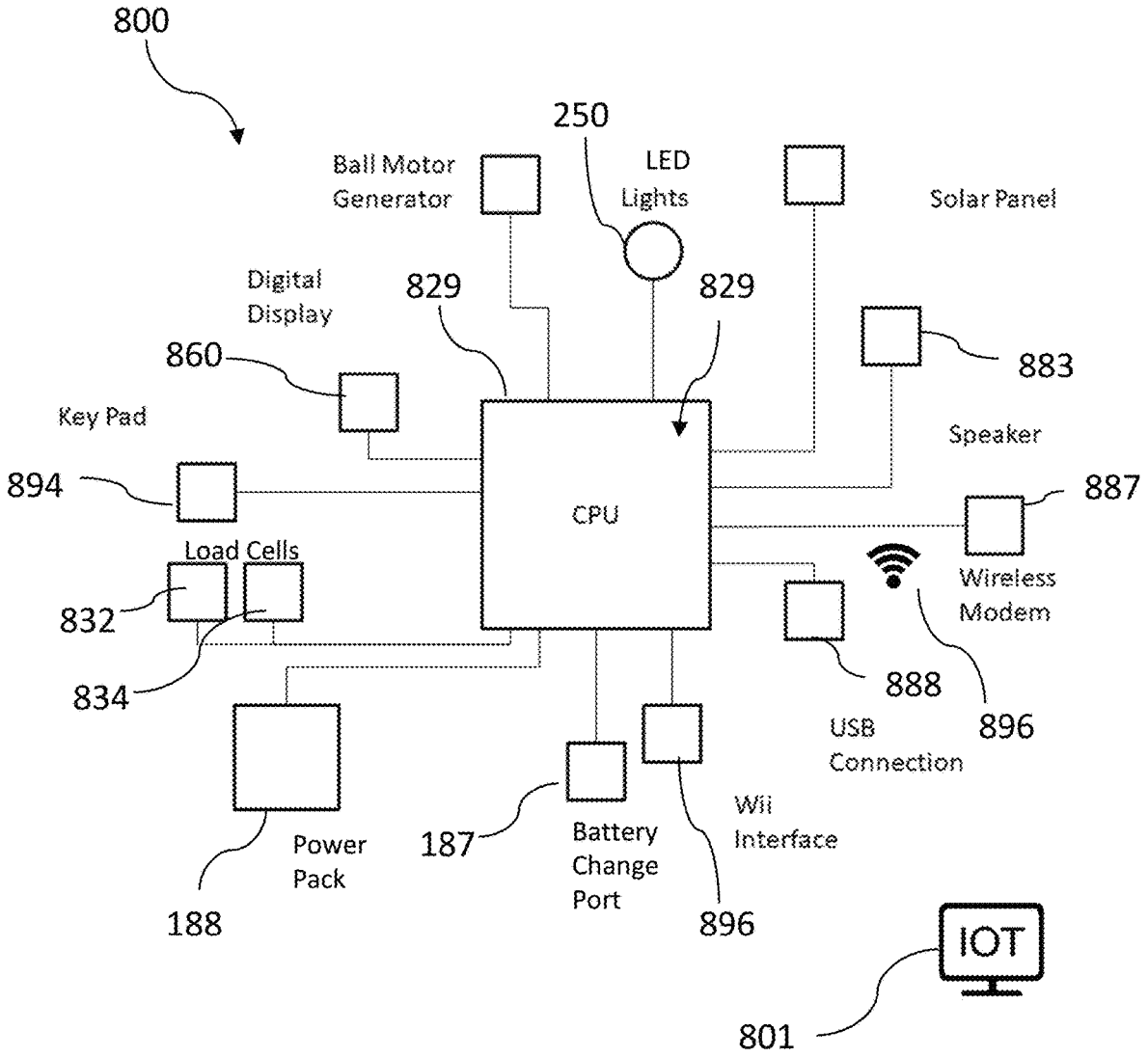
FIG. 8 illustrates a computer system of the rod and head assembly for a tennis ball training system.

FIGS. 1 and 2 further illustrate an optical sensor assembly 230 designed to determine ball member 130 spin. This optical sensor assembly 230 accounts for the fact that ball members 130 such as a tennis ball will deform when hit, as tennis balls are designed to do, but the spin on the tennis ball can be calculated before deformation becomes significant enough to distort calculations of spin. An infrared sensor that may serve as the optical sensor assembly 230 is disposed on the outside surface of the concave proximal face portion of the ball cup member 241 and is similar or the same as an optical sensor assembly 230 used on a computer mouse trac ball wherein a LED laser 233 laser beam is projected onto a targeted first surface portion of the ball member 131 at an acute angle from perpendicular to the targeted first surface portion of the ball member 131 and reflects to a light sensor 234. Because the optical sensor assembly 230 can leverage the speed of light reflecting substantially from the ball member 130 to create data from the behavior of the ball member 130, limited thereafter, with reference to FIG. 8, only by the speed of the microprocessor 829 using the data, the microprocessor 829 can obtain the information needed to determine spin from micro-changes in the first surface portion of the ball member 131 position. With reference to FIG. 8, a computer system 800 can, therefore, track the spin that would have been imparted on a free tennis ball before the ball member 130 in the ball cup member 140 substantially deforms. There are no moving parts and no need for a momentum-based or force-impact sensor to determine the spin on the ball member 130. A three-axis impact sensor assembly 240 is arrayed on three axes within the head assembly 100 and positioned distally to the proximal face portion of the ball cup member 242 to detect head movement. The three-axis impact sensor assembly 240 is made from force impact sensors that detect changes of movement along three axes x, y, and z, which will vary depending upon the force and angle of impact on the ball member 130, thereafter transferred to the head assembly 100.

Figure 10:
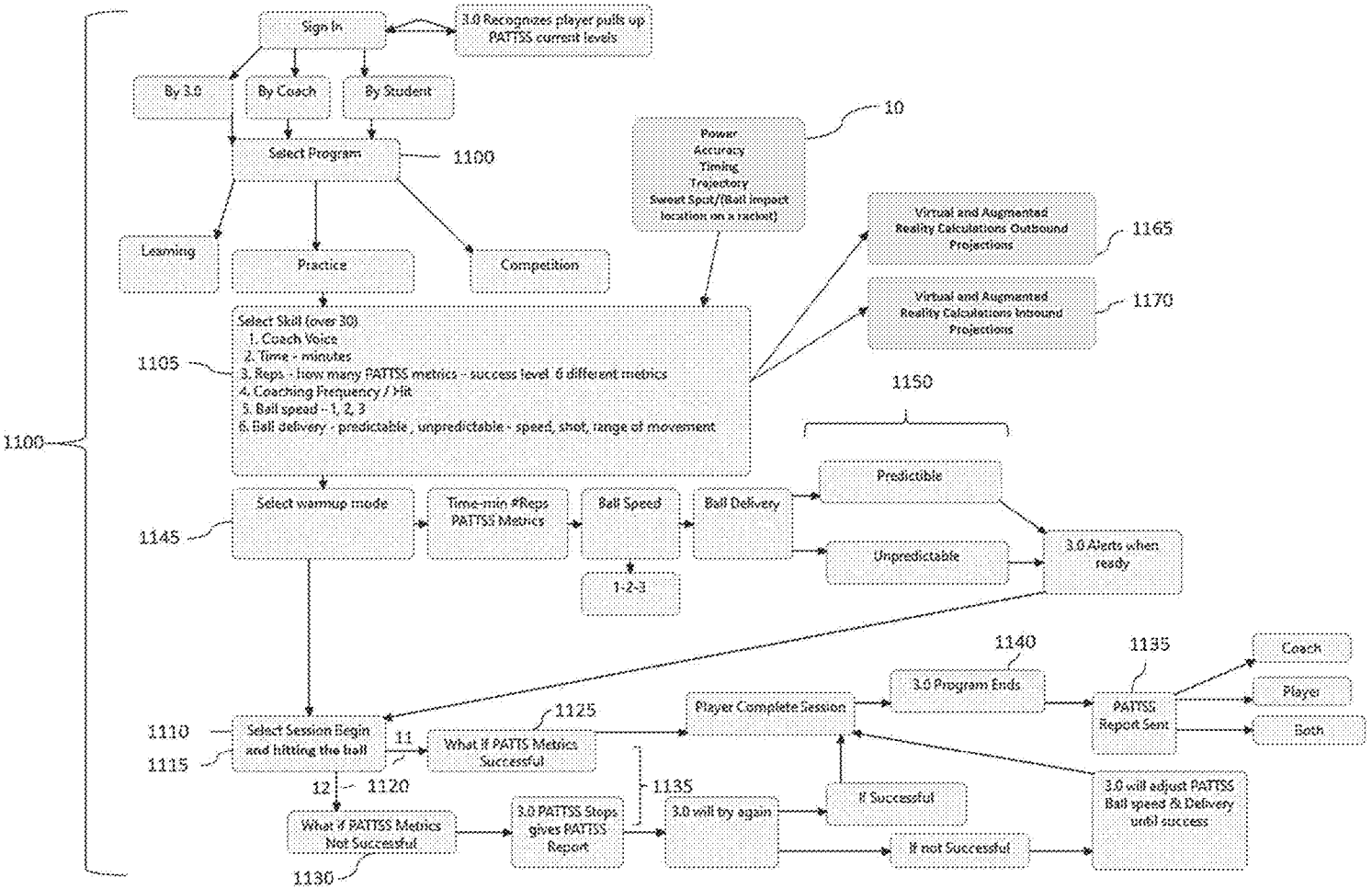
FIG. 10 illustrates the PATTSS flow (Power, Accuracy, Timing, Trajectory, Spin, Sweet spot.) training format of the rod and head assembly for a tennis ball training system.

FIGS. 1 and 2 further illustrate an embodiment where at least one tri-colored light-emitting diode member (LED) light member 250 is mounted at a top portion of the ball cup member 241, electrically and operably coupled by at least one electrical coupling member 253 to the sensor assemblies 230, 240. At least one light detecting photodiode optical sensor assembly 230 is designed to detect spin force from the first surface portion of the ball member 131 when the racket impacts the ball member 130. The LED light member 250 can produce up to 256 different colors of light and has periodic light production capabilities from which to produce flashes of different lengths, patterns, and intensities. The colors and patterns serve to provide feedback and instruction, for example, to tell a user that the spin, timing, or trajectory of the ball member 130 as that ball member 130 would move if not held by the ball cup member 140 are correct or incorrect, or to signal which hit to perform next. A process underlying how the LED light member 250 is used, with reference to FIG. 10, is an Eye Coach PATTSS flow process 1000. The LED light member 250 will also be operably connected to a flex sensor 260 within the polymer flexible rod assembly 120 holding the head assembly 100, the flex sensor 260 detecting the bend of the polymer flexible rod assembly 120 and operably connected to the three-axis impact sensor assembly 240 to match bend with the timing of an impact. As a training tool, the intent is for a student to time the impact of his or her racket on the ball member 130 when the oscillating polymer flexible rod assembly 120 is straight up and with substantially no bend. The LED light member 250 will present a color, pattern, or both within $1/10^{th}$ second of impact with a racket, for example, a color communicating feedback about the shot, such as the spin and placement on the racket—sweet spot—and a pattern communicating the next shot to attempt, such as a spin or backhand. More than one LED light member 250 may be mounted, for example, one for showing a color and another for showing a pattern. The LED light member 250 in this embodiment will be timed to shut off at the critical moment before a racket hit accorded to the Eye Coach PATTSS flow process 1000 training method so that the user will not be distracted by the LED light member 250 in the moment when the user must focus on the ball member 130, the representative 3 feet a tennis ball represented by the ball member 130 travels before the racket makes contact. The LED light member 250 can be used in lieu of, or to complement, or to be complemented by, audio instructions where the light-base instructions better allow for a setting where multiple students train and where audio feedback or instructions could be distracting. Audio signals, when used, may provide verbal feedback or instructions. Audio signals may also be used to provide spin feedback to account for some loss of feel by a ball member 130 that is not spinning in the head ball cup member 140 and whether the player his impacted the ball member 130 on the sweet spot of the racket. Just as a baseball player and people in the stands can hear a certain quality of impact when a player hits a home run, a tennis player will know a certain quality of sound associated with a good hit, a sound which can be emulated to provide added feedback and the satisfaction of a good hit. An example of use would be to have audio communicate the success of the shot, perhaps with a color indicator LED light member 250 as well, and then have a flash or audio signal communicate the next shot to take. Such could be a programmed item where either light or audio could be a solo, dual, or omitted source of feedback.

FIGS. 1 and 2 further illustrate that sensors in this embodiment will be connected through wire members 254, and a central ribbon wire member 256 bent so that it is driven into a ribbon wire connector member 257 when a user hits the ball member 130. Connections may also be wireless with associated antenna. The positioning of the central ribbon wire member 256 is important for system durability given that wires withstand being pressed better than stretched. The ribbon wire member 256 will be enclosed, and a supplementary cap portion 258 may be included to help protect the ribbon wire member 256 and seat the head assembly 100. The ribbon wire member 256 is electrically coupled to a power source 160 by a bottom portion of the ribbon wire member 259. A top portion of the ribbon wire member 251 is coupled to a distal surface of the ball cup member 140, the top portion of the ribbon wire member 251 disposed to substantially abut, as illustrated in FIG. 3, the proximal face of the retaining plate member 311.

Figure 4:
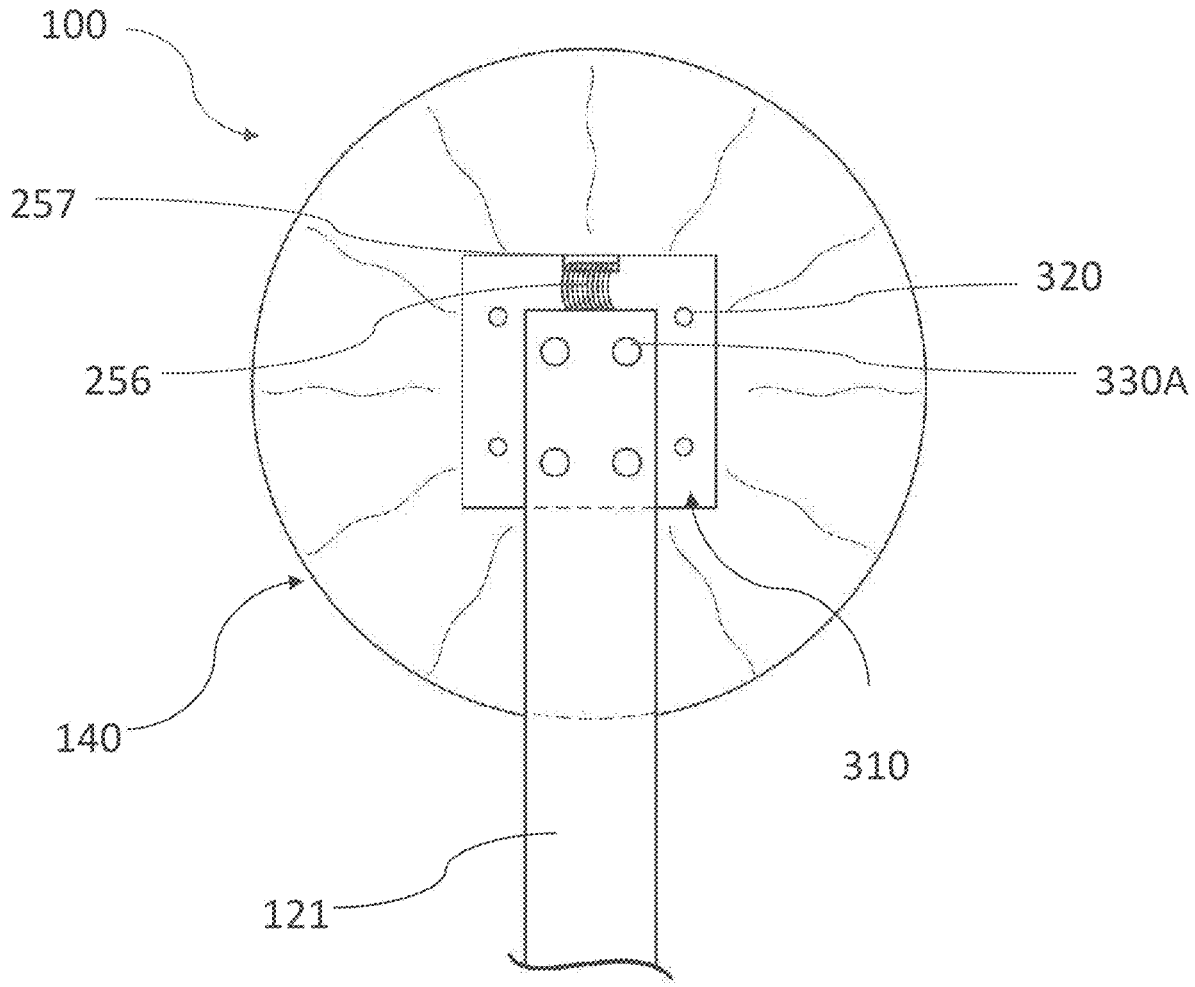
FIG. 4 illustrates the back view of the head assembly of the rod and head assembly for a tennis ball training system.

FIGS. 1, 3, and 4 illustrate an embodiment of the vertical polymer flexible rod assembly 120. The head assembly 100 is coupled to the top portion of the vertical polymer flexible rod assembly 121, a bow-flex style polymer rod assembly, at a distal surface of the ball cup member 140, by a retaining plate member 310 with four bolt attachment hole members 320 and associated helically threaded attachment members 321 wherein the vertical polymer flexible rod assembly 120 is sandwiched between the head assembly 100 in a concave proximal face portion of the retaining plate member 311. The position is maintained by projection members 331 inserted through the four projection attachment hole members 330A of the retaining plate member 310 and four projection attachment hole members 330B of at the top portion of the vertical polymer flexible rod assembly 121 that are at least partially slidable to account for impact but that have the role to keep the head assembly 100 aligned and on the vertical polymer flexible rod assembly 120 as projection members that are unthreaded. The attachment hole members in the bow may further be reinforced by rubber, hollow, cylindrical pin members 332 so that the rubber, hollow, cylindrical pin members 332 are subjected to potentially wearing forces instead of the vertical polymer flexible rod assembly 120, and so that the rubber, hollow, cylindrical pin members 332 can be replaced without replacing the entire vertical polymer flexible rod assembly 120. Also at the top portion of the vertical polymer flexible rod assembly 121 is the ribbon wire member 256 and the ribbon wire connector member 257 with the retaining plate member 310 serving as a backstop so the ribbon wire member 256 may be subject to compression, which it can withstand better than stretching. The vertical polymer flexible rod assembly 120 eliminates a requirement for a metal spring.

Figure 5:
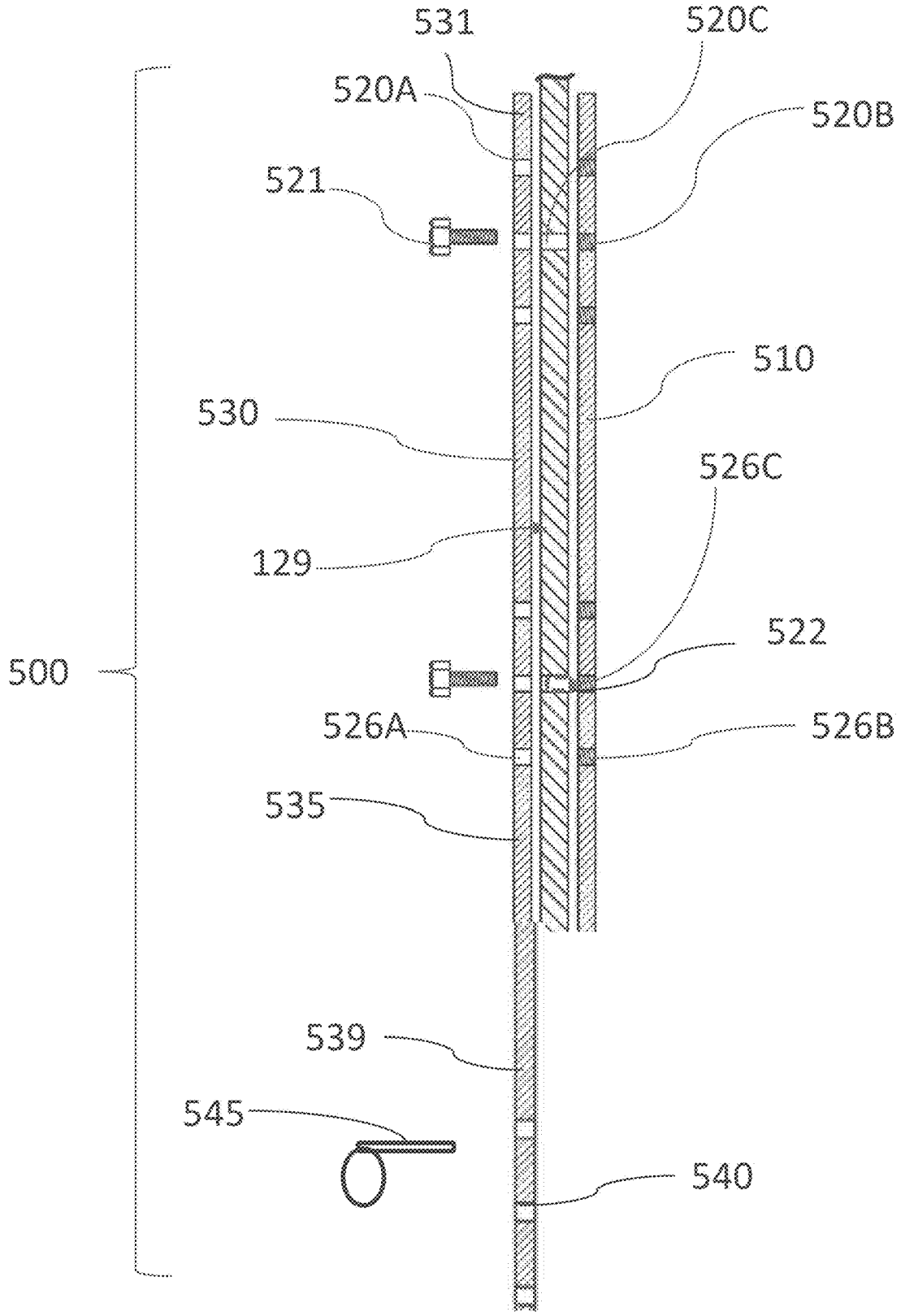
FIG. 5 illustrates a lower portion of the rod assembly of the rod and head assembly for a tennis ball training system.

FIGS. 1 and 5 illustrate an embodiment of the vertical polymer flexible rod assembly 120 that is supported at a bottom portion of the vertical polymer flexible rod assembly 129 by a backplate member 510 and a metal base plate member 530 that form a base mount assembly 500. The backplate member 510 has at least three threaded attachment hole members in a top portion of the metal base plate member 531 and at least three upper attachment hole members 520A in a bottom of the metal base plate member mirrored by at least three non-threaded attachment hole members 520C through the top portion of the metal base plate member and at least three non-threaded attachment rod hole members 520B through a lower portion of the vertical polymer flexible rod assembly 129 wherein a plate helically threaded attachment member 521 disposed through each attachment hole member sandwiches the greater assembly 500 and 129 together. This embodiment of the backplate member 510 has at least three additional threaded attachment hole members in a middle portion of the metal base plate member 535 and at least three upper attachment hole members 526A in a bottom of the metal base plate member mirrored by at least three non-threaded attachment hole members 526C through the top portion of the metal base plate member and at least three non-threaded attachment rod hole members 526B through a lower portion of the vertical polymer flexible rod assembly 129 wherein a plate helically threaded attachment member 521 disposed through each attachment hole member further sandwiches the greater assembly 500 and 129 together. The attachment hole members 520A-520C and 526A-526C in this portion of the vertical polymer flexible rod assembly 120 may also further be reinforced by plate rubber, hollow, cylindrical pin members 522 so that the rubber on the plate rubber, hollow, cylindrical pin members 522 are subjected to potentially wearing forces instead of the polymer of the vertical polymer flexible rod assembly 120. The plate rubber, hollow, cylindrical pin members 522 can be replaced without replacing the entire vertical polymer flexible rod assembly 120. An upper portion of the vertical polymer flexible rod assembly 120 is designed to oscillate from racket impact energy imparted on the ball cup member 140 and the associated head assembly 100. At least one bottom base attachment hole member 540 on a bottom portion of the base plate member 539 is designed to be aligned with at least one removable lock pin member 545 and, with reference to FIG. 1, at least one hole member of a substantially hollow vertical sleave member 170 of the stand assembly 110. The thickness of the plate members 510, 530 in this embodiment is about one-sixth of an inch thick, though other thicknesses could be used, and in this embodiment is made from galvanized steel, though other metals or polymers could be used. The bottom portion of the metal base plate member 530 is mounted to the stand assembly 110 through a series of the at least one removable lock pin member 545 on the hollow vertical sleave member 170. The at least one attachment hole members 540 disposed through the bottom portion of the metal base plate member 539 and the hollow vertical sleave member 170 allows, in this embodiment, the height of the vertical polymer flexible rod assembly 120 and head assembly 100 to be set higher or lower by substantially eighteen inches at six-inch intervals in the preferred embodiment though other spacings could be used.

Figure 6:
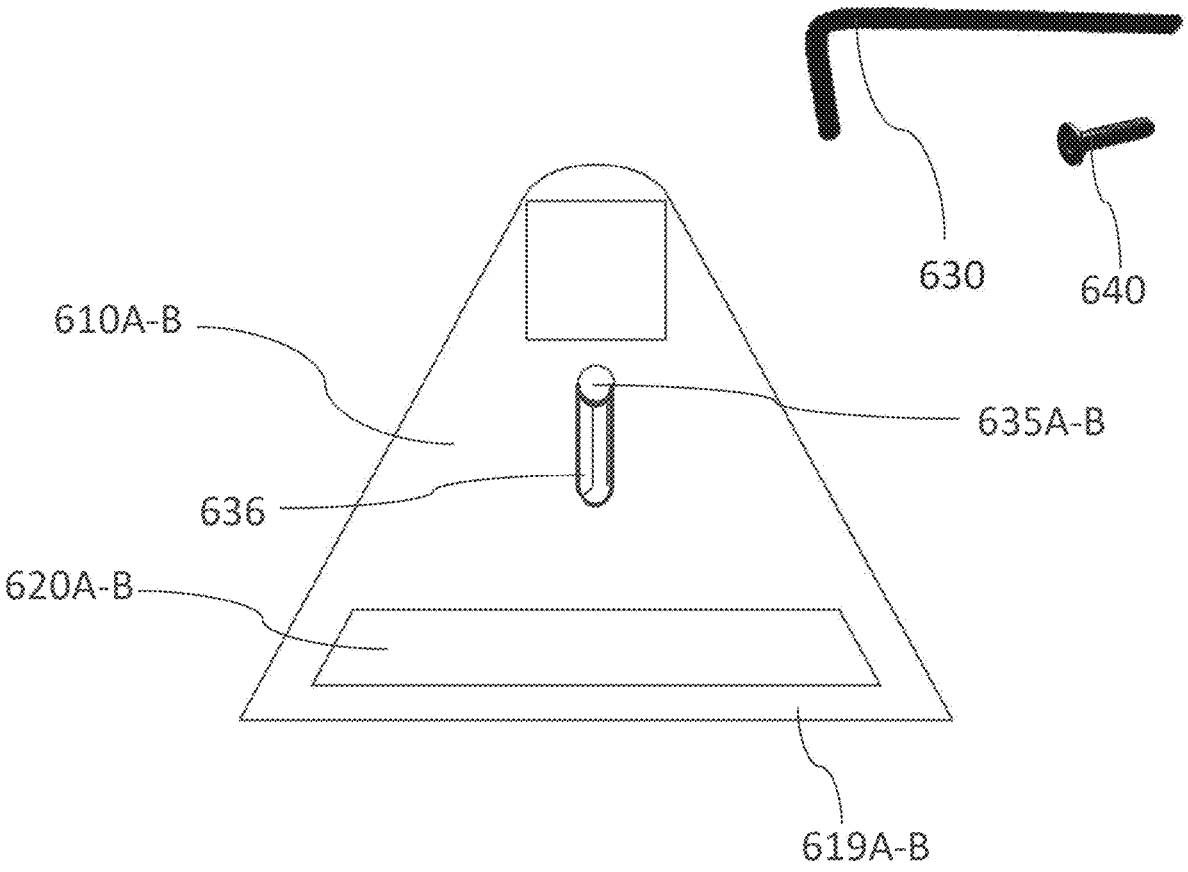
FIG. 6 illustrates a proximal view of a polymer boot member of the rod and head assembly for a tennis ball training system.
Figure 7:
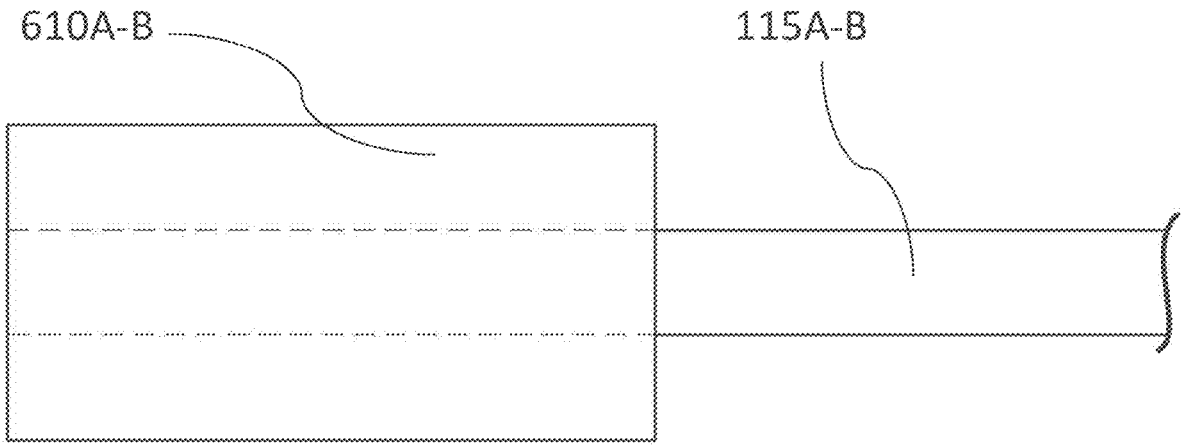
FIG. 7 illustrates a side view of the polymer boot member of the rod and head assembly for a tennis ball training system.

FIGS. 1, 6, and 7 includes elements of the stand assembly 110 inclusive of right and left polymer boot members 610A-610B at right and left proximal ends of the stand assembly 111A-111B, the polymer boot members 610A-610B disposed partially over each of right and left horizontal leg members 115A-115B, the polymer boot members 610A-610B having a concave, compressible space 620A-620B above a base portion of each polymer boot members 619A-619B for shock absorption. An Allen wrench slot portion 635A-635B is disposed in the polymer boot members 610A-610B to secure at least one Allen wrench 630, the Allen wrench slot portion 635A-635B having an elongate horizontal portion and a shorter vertical depression portion in which fits substantially an entire Allen wrench and may also have a cog or otherwise an at least semirigid flap or spur of polymer 636 that secures the Allen wrench so that it cannot slide out on its own. The screw members on the preferred embodiment will be Allen-head screw members 640 with fine threads designed to handle more torque than similarly sized helically threaded connectors with strait or Phillips heads.

FIGS. 1, 2, and 8 illustrate the computer system 800 designed to receive, process, dispense, store, and analyze data, wherein the preferred embodiment puts these items within or attached to the stand assembly 110 and wherein those elements would not be subject to the forces of training impact. The computer system 800 would also, therefore, be a part of the most durable element of the system and may be its own standalone module coupled to the stand assembly 110. These elements will be designed to work independently of a network or smart device but could also be designed for an Internet of Things (IoT) environment 801 as might be a training environment where the state of the systems in use can be monitored and items, such as needed maintenance, detected before such items can damage other parts of the system. Where audio is used, a speaker assembly 883 is included and operationally coupled to the microprocessor 829. The computer system 800 can be standalone, can be made to use apps from a smartphone, or both. The system may also be gamified so that users can play against their own performance or against the performance of others. Two load cells 832, 834 may be provided for added data to determining whether the ball member 130 is properly struck with a racket by the user.

Figure 9:
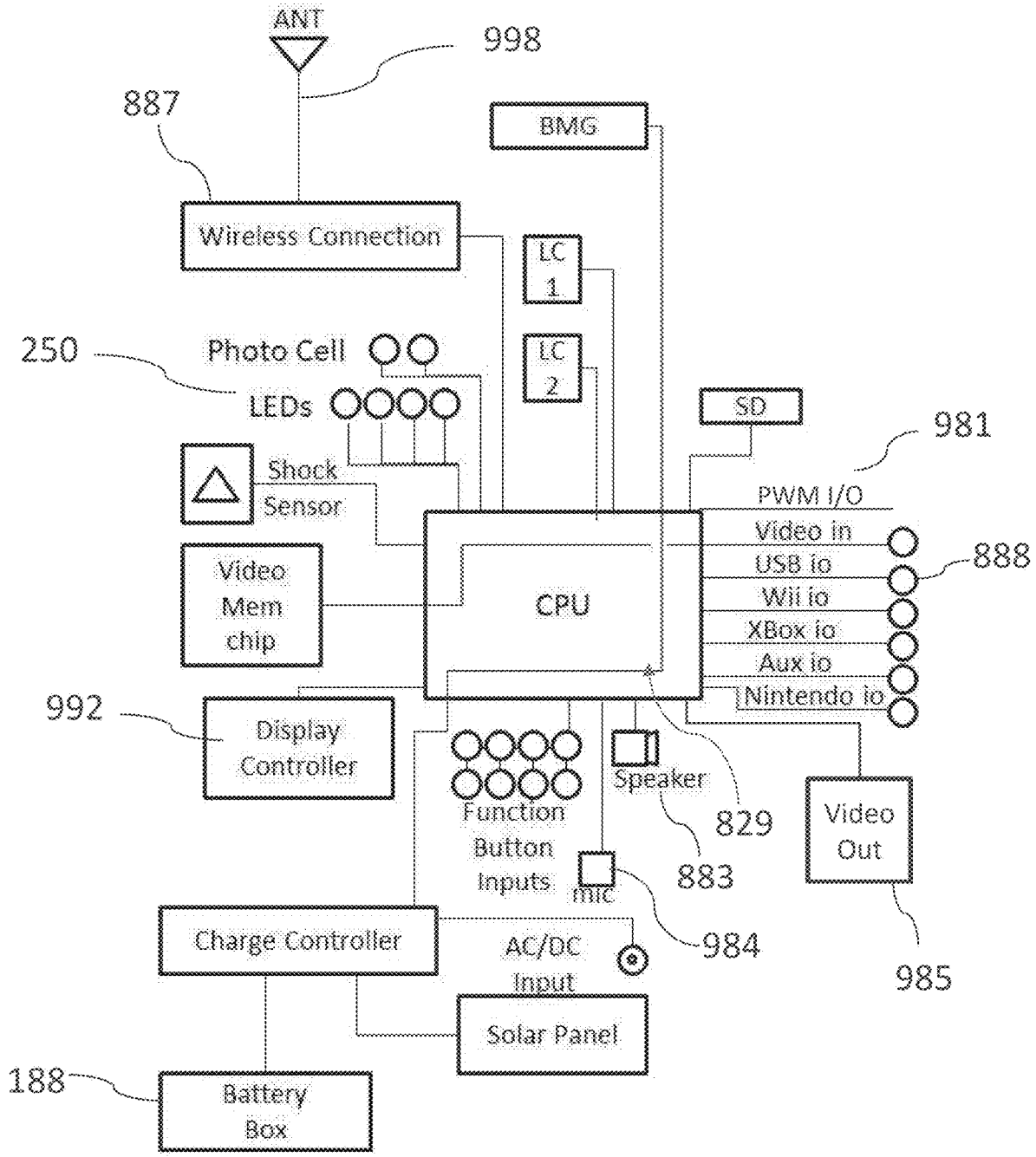
FIG. 9 illustrates interface components of the rod and head assembly for a tennis ball training system.

FIGS. 1 and 8 further illustrate a USB port 888 for data, control operation of the speaker 883, clear stored data, with reference to FIG. 9, control operation of a microphone 984, cause data to be displayed on a display 860, cause training data to be stored in the microprocessor or CPU 829, to control operation of the USB port 888, control operation of the Wii port 896, and control connection to an external device such as but not limited by an Xbox, Wii, or Nintendo. The display 860 can display items including amount of practice time elapsed, total hits, total good hits, remaining practice time, whether ball spin has been initiated, indicate on/off status and/or provide a system ID. The microprocessor 829 for controlling operation of the present inventive concept is also housed in a base assembly 174 as well as being powered by one or more battery members 160 or similar devices stored in a power pack 188 and operationally coupled to a charging port 187.

With reference to FIGS. 2 and 9, the microprocessor 829 is operably coupled to the electronic components in the inventive concept. There are several Input/Output (I/O) signals and ports on the device such as a Pulse Width Modulation (PWM) I/O signal 981, an Audio Output (Speaker) 883, as well as for Video Output 985, and Data signal outputs. The device will also have multiple wireless capabilities, such as Bluetooth or Wi Fi wireless connections 887 to routers. These interfaces with other electronic devices provide for remote interaction, training, and programming. The main function is to monitor and record all inputs, calculate that raw information, and provide real-time feedback. Sensor 230, 240, 260 and feedback profiles may be programmed into the local memory of the inventive concept or may be in the cloud or on an operationally coupled device such as a smartphone or computer pad. Parameters for performance will be programmed into different levels, and multiple voice responses may randomly be given via the speaker 883 for the same result. i.e.: "Well done", "Good job", "That's the way", "Way to go", and several others, may be pre-programed audio type responses generated from the device for a good hit, or the user might receive audio cues, such as a sound emulating a well hit or poorly hit ball, or visual signals from the light-emitting diode member/LEDs. A microphone 984 may be provided to allow communications between a user and the microprocessor 829. A USB port 888 is provided to allow easy transfer of data stored in the microprocessor 829. The microprocessor 829 may be coupled to an Xbox or Nintendo or such device as desired, wirelessly or directly. The digital display controller 992 allows display of data resulting from use of the inventive concept in a suitable format for easy viewing and understanding. The data to be displayed can include amount of time practiced, total hits, total good hits, remaining practice time, direction of ball spin, an indicator showing that the device is operable as well as log-in information. Also associated with the microprocessor 829 is a keypad 894 allowing inputting of commands to the microprocessor 829. A Wi-Fi interface 896 allows wired connection to the Internet while a wireless connection 887 also has an antenna 998 to facilitate wireless Wi-Fi connection. These Wi-Fi connections permit communications with remote teachers or other persons or machines.

FIG. 10, illustrates the PATTSS flow 1000 which, in this embodiment, would be utilized within the computer system 800 to train a student. PATTSS 10 of the PATTSS flow 1000 stands for (Power, Accuracy, Timing, Trajectory, Spin, Sweet spot.). Power is the energy delivered to a ball. Accuracy is where the player places the ball. Timing is when the player hits the ball. Trajectory is how the ball travels. Spin is the rotation the player imparts on the ball. Sweet spot is the place of impact on the racket. Additional sensors beyond those disclosed for this embodiment (230, 240, 260) may be applied to determine sweet spot or statistical assessments may be considered based on the probability that certain results will be achieved through results obtained from the other PATTSS categories, for example, that a ball is statistically likely to behave in a desired way after a hit if the ball is consistently hit in the sweet spot.

FIG. 11A-11D illustrates a method of using the head assembly 100 and the bendable shaft assembly 120 for the tennis ball training system for a user, the method including the step of 1100, selecting a training program from the computer system 800, the computer system 800 operationally coupled to the head assembly 100, the bendable shaft assembly 120, the at least one optical sensor assembly 230, the at least one three-axis impact sensor assembly 240, and the at least one flex sensor assembly 260, the training program from at least one or more of learning, practice, and competition. The method further includes the step of 1105, selecting a skill from at least one or more selected from a group of time, repetition, ball speed, ball delivery, the skill quality developed from at least one or more from the PATTSS 10 group of power, accuracy, timing, trajectory, spin, and location of ball impact on the racket. The method further includes the step of 1110, selecting the start of a training session and beginning the training session. The method further includes the step of 1115, hitting with the racket the ball member 130 held by the head assembly 100, the success of each hit determined by the at least one optical sensor assembly, 230, the at least one three-axis impact sensor assembly 240, the at least one flex sensor assembly 260 disposed as a part of the head assembly 100 and the bendable shaft assembly 120. The method further includes the step of 1120, the training session following substantially two tracks for evaluated action, a first track 11 if the at least one or more from the PATTSS 10 group of power, accuracy, timing, trajectory, spin, and location of ball member impact on the racket metrics indicate hit success and a second track 12 if the at least one or more from the PATTSS 10 group of power, accuracy, timing, trajectory, spin, and location of ball member impact on the racket metrics indicate hit failure. The method further includes the step of 1125, successful hits leading toward completing a training program, wherein a successful hit may be considered at least one or more of power, accuracy, timing, trajectory, spin, and the location of impact of the ball member 130 on the racket, the location of impact sought being the sweet spot in substantially the center of the racket face, success also a measure of where and how the impacted ball member 130 would travel and land. The method further includes the step of 1130, failed hits leading toward adjusting at least one or more of the training program, skill, and skill quality, the adjustment designed to foster the user achieving metrics of success. The method further includes the step of 1135, recording training program data. The method further includes the step of 1140, ending the training program session.

FIG. 11A-11D further illustrates that the method of using the head assembly 100 and the bendable shaft assembly 120 for the tennis ball training system may include the step of 1145, starting a warm-up mode before starting the training session, the warmup measuring at least one or more of the skill quality developed from at least one or more from the PATTSS 10 group of hit power, accuracy, timing, trajectory, spin, and location on the racket.

FIG. 11A-11D further illustrates that the method of using the head assembly 100 and the bendable shaft assembly 120 for the tennis ball training system may include the step of 1150, the warmup mode including selecting warmup time, ball dynamics, and at least one or more of predictable and unpredictable hit requirements.

FIG. 11A-D further illustrates that the method of using the head assembly 100 and the bendable shaft assembly 120 for the tennis ball training system may include the step of 1155, the at least one flex sensor assembly 260 detecting bending of the polymer flexible rod assembly 120, the bend providing data for at least partially determining the timing for hitting the ball member 130.

Figure 11A:
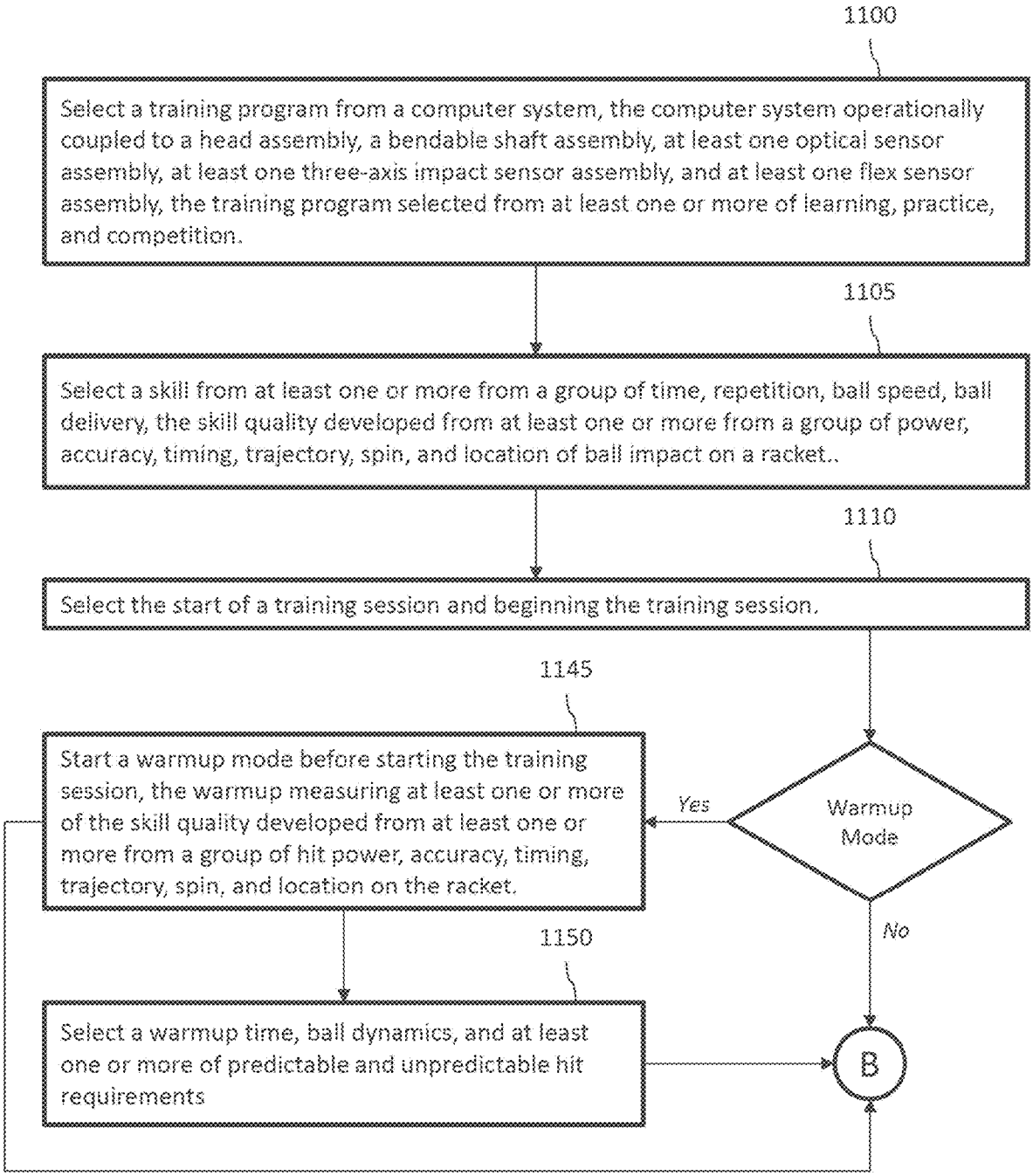
FIGS. 11A-11D illustrate a method for using the rod and head assembly further using PATTSS.
Figure 11B:
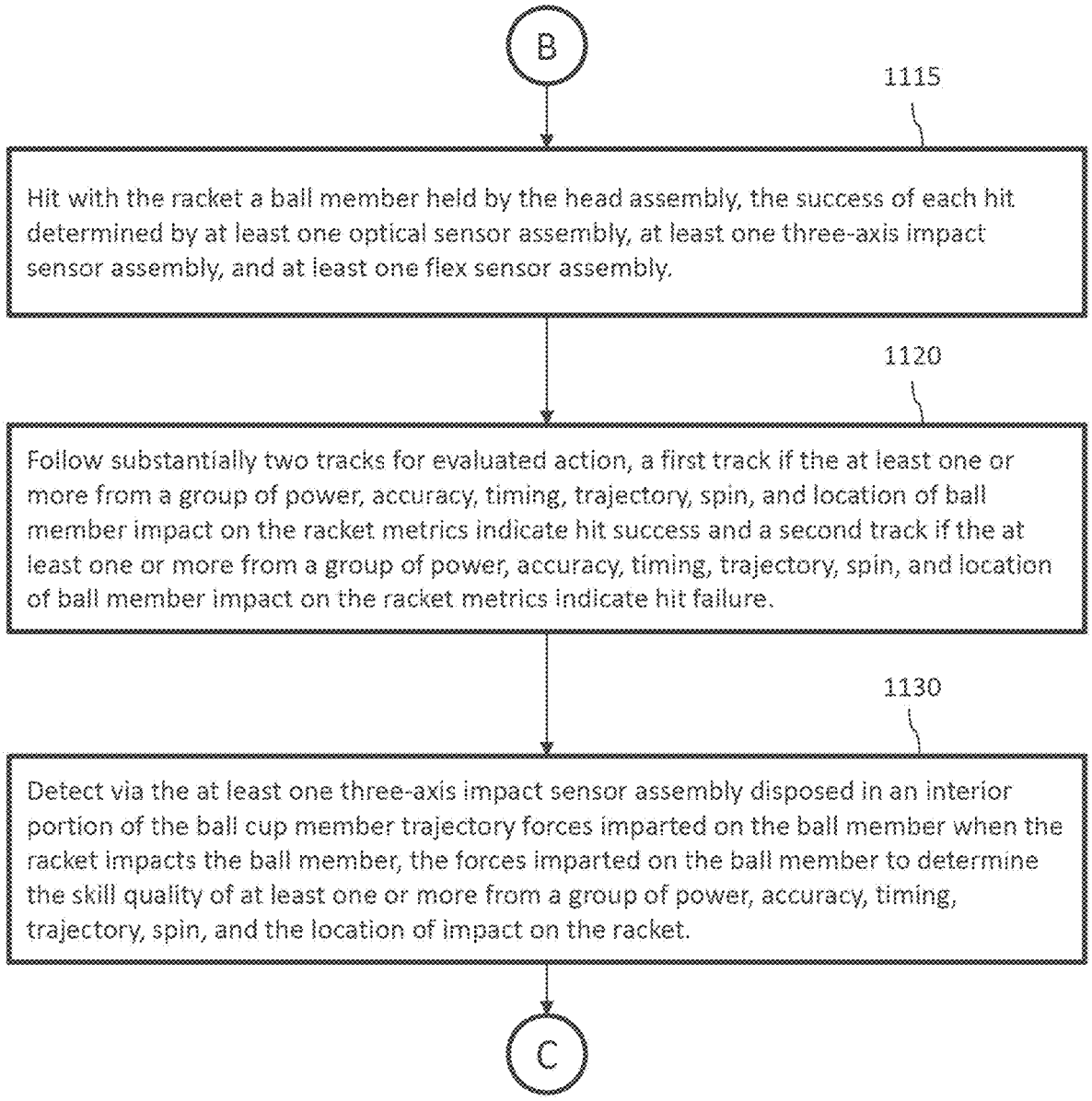
Figure 11C:
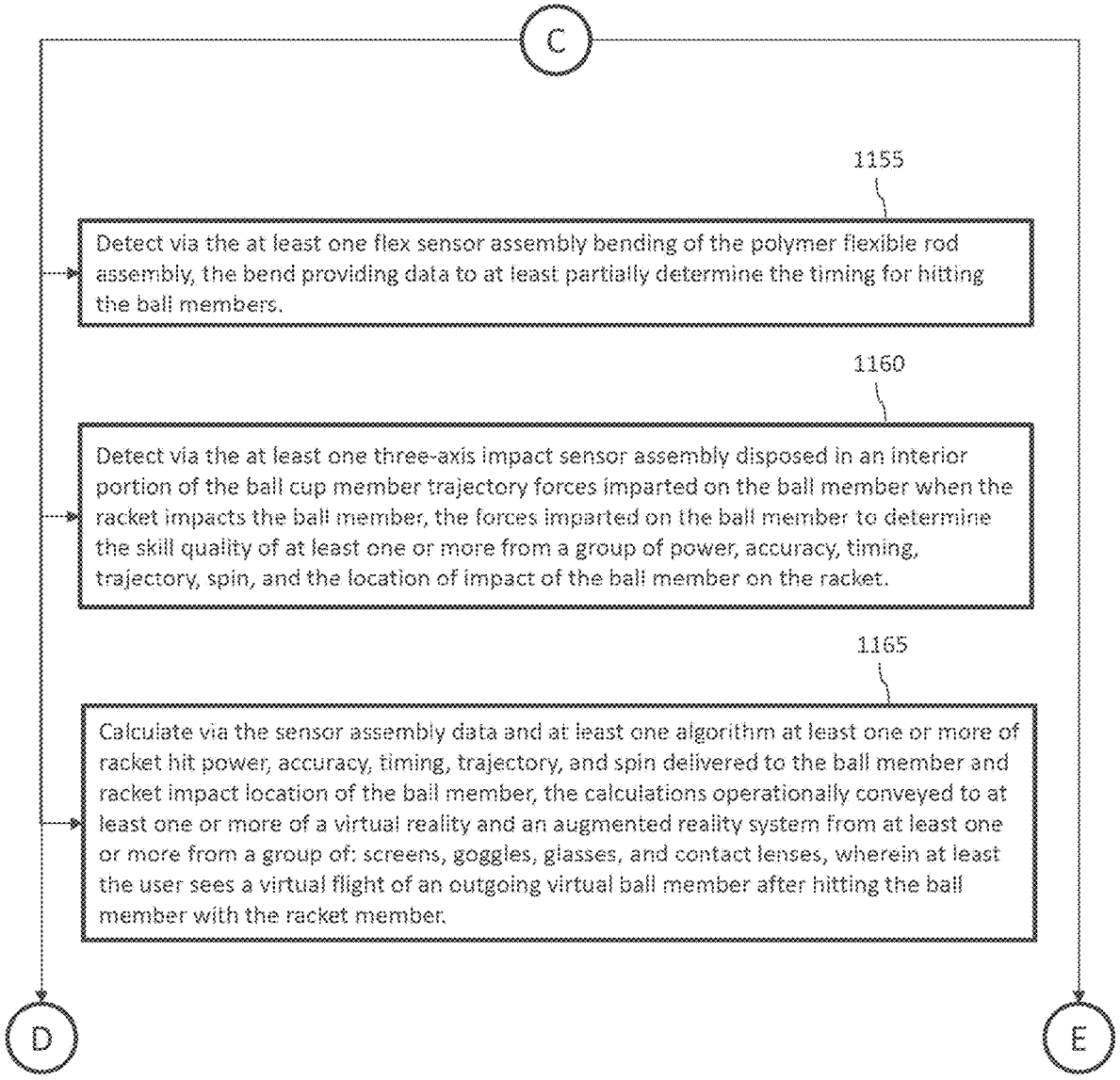
Figure 11D:
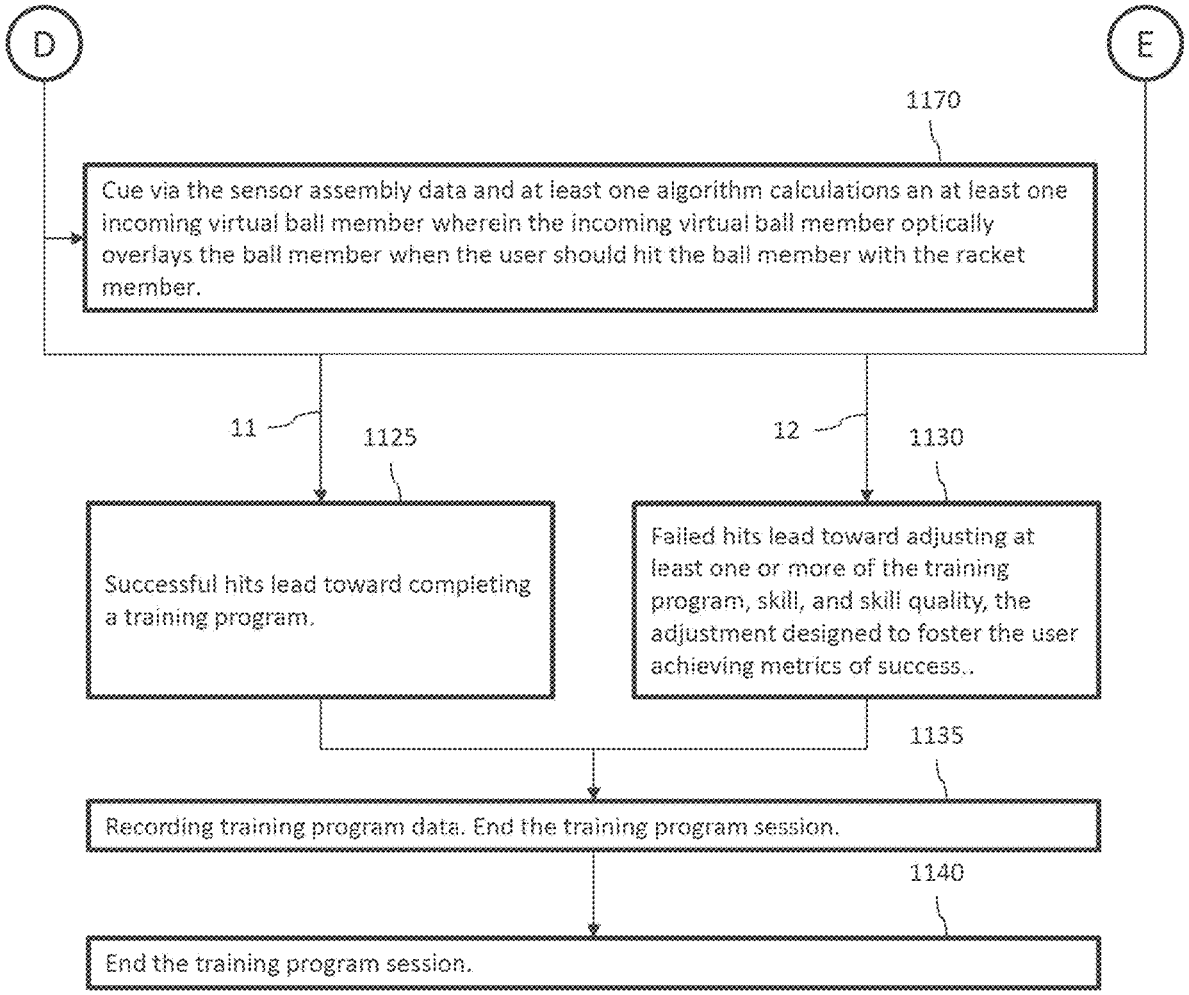

FIG. 11A-1D further illustrates that the method of using the head assembly 100 and the bendable shaft assembly 120 for the tennis ball training system may include the step of

1160, the at least one three-axis impact sensor assembly 240 disposed in an interior portion of the ball cup member 140 detecting trajectory forces imparted on the ball member 130 when the racket impacts the ball member 130, the forces imparted on the ball member 130 determining the skill quality of at least one or more from the PATTSS 10 group of power, accuracy, timing, trajectory, spin, and the location of impact of the ball member 130 on the racket.

Figure 12:
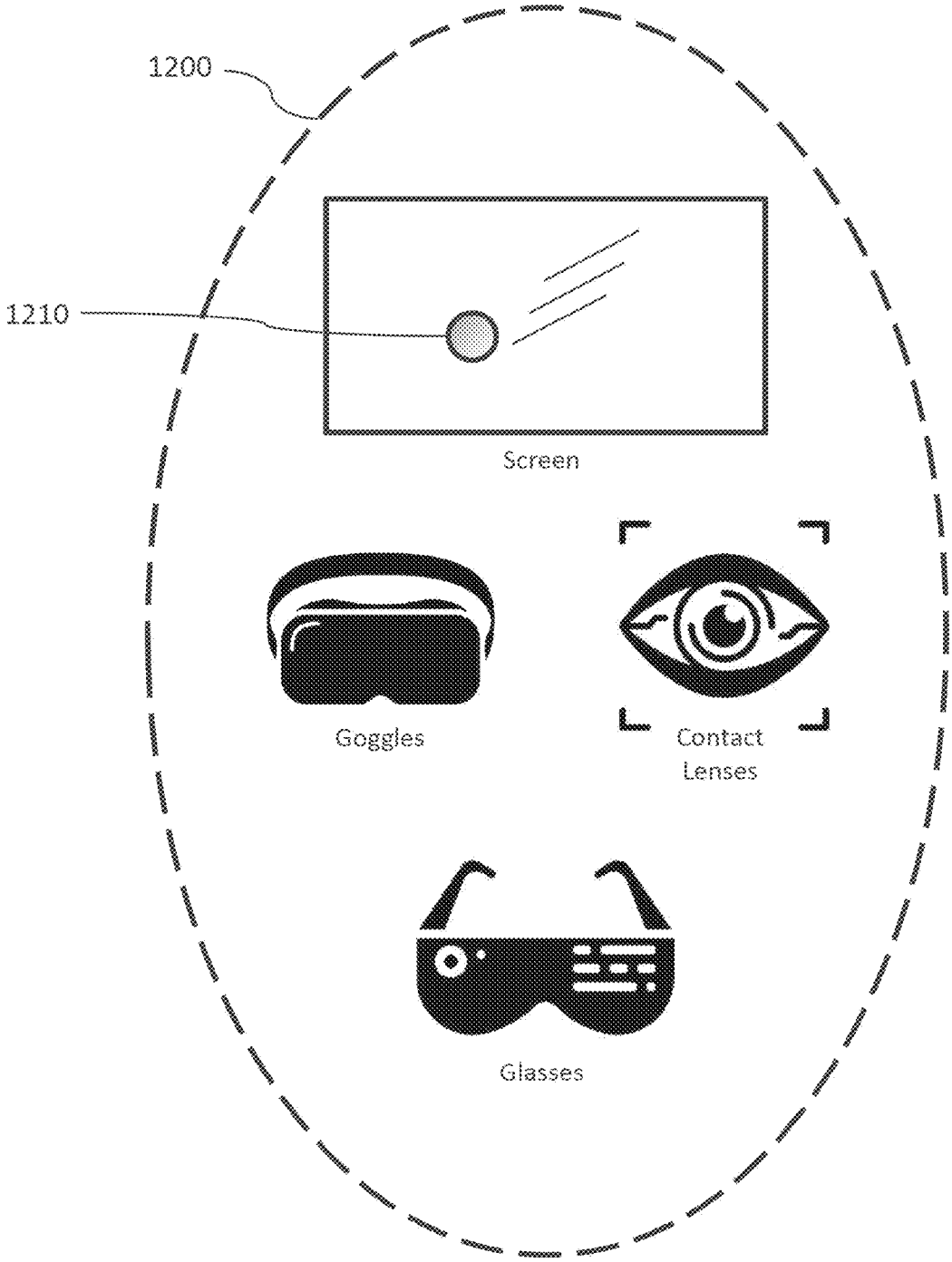
FIG. 12 illustrates a group of virtual and augmented reality screen, goggles, glasses, and contact lenses.

FIG. 11A-11D further illustrates that the method of using the head assembly 100 and the bendable shaft assembly 120 for the tennis ball training system may include the step of 1165, the sensor assemblies 230, 240, 260 data and at least one algorithm calculating at least one or more of racket hit power, accuracy, timing, trajectory, and spin delivered to the ball member 130 and racket impact location of the ball member 130, the calculations operationally conveyed to at least one or more of the virtual reality and the augmented reality system from the at least one or more from, as illustrated in FIG. 12 a group of 1200: screens, goggles, glasses, and contact lenses, wherein at least the user sees a virtual flight of an outgoing virtual ball member 1210 after hitting the ball member 130 with the racket.

FIG. 11A-11D further illustrates that the method of using the head assembly 100 and the bendable shaft assembly 120 for the tennis ball training system may include the step of 1170, the sensor assemblies 230, 240, 260 data and at least one algorithm calculations cuing an at least one incoming virtual ball member 1210 wherein the incoming virtual ball member 1210 optically overlays the ball member 130 when the user should hit the ball member 130 with the racket.

FIG. 12 illustrates the group of virtual and augmented reality screen, goggles, glasses, and contact lenses 1200 and the virtual ball member 1210.

The following patents are incorporated by reference in their entireties: U.S. Pat. Nos. 7,070,520, 8,333,671, 2013/0196794, and 7,169,067.

While the inventive concept has been described above in terms of specific embodiments, it is to be understood that the inventive concept is not limited to these disclosed embodiments. Upon reading the teachings of this disclosure many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. A head and rod assembly for a tennis ball training system comprising: a polymer ball cup member with a substantially concave proximal face portion and a rim portion assembly, the concave proximal face portion adapted to be coupled to a ball member by the rim portion assembly of the concave proximal face portion, substantially the entirety of the concave proximal face portion supporting and contiguously abutting a first surface portion of the ball member;

the rim portion assembly comprising of a at least one removable, helically threaded retaining ring member coupled to a proximal, helically threaded lip portion of the ball cup member, an interior surface of the retaining ring member substantially contiguously abutting a second surface portion of the ball member, the sum of the first and second surface portions of the ball member greater than fifty percent of a total surface area of the ball member;

at least one optical sensor assembly outwardly disposed along the concave proximal face portion of the ball cup member, at least one light-emitting diode member and at least one light detecting photodiode (LED) member adapted to detect a spin force from the first ball surface portion when a racket impacts the ball member;

at least one three-axis impact sensor assembly disposed in an interior portion of the ball cup member adapted to detect trajectory forces imparted on the ball member when the racket impacts the ball member; a distal surface of the ball cup member opposite the rim portion assembly coupled by at least one attachment member to a substantially vertical polymer flexible rod assembly, the vertical polymer flexible rod assembly bearing at least one flex sensor assembly adapted to detect bending of the polymer flexible rod assembly;

at least one LED light member disposed on a top portion of the ball cup member adapted to emit at least one light color in one or more defined patterns;

at least one electrical coupling member disposed on the distal surface of the ball cup member electrically coupled to the at least one optical sensor assembly, the at least one three-axis impact sensor assembly, and the at least one LED light member; and the at least one optical sensor assembly, the at least one three-axis impact sensor assembly, and the at least one flex sensor assembly electrically coupled to a computer system, the computer system having a controller through which the computer system calculates and communicates results from the sensor data by way of at least one or more of an algorithm and a memory-enabled program.

2. The head and rod assembly for a tennis ball training system of claim 1 wherein at least one or more of a flash and audio signal communicate the next hit on the ball member for a user to make with the racket.

3. The head and rod assembly for a tennis ball training system of claim 1 wherein the at least one optical sensor assembly, the at least one three-axis impact sensor assembly, and the at least one flex sensor assembly provide data from which at least one algorithm calculates at least one or more of racket hit power, accuracy, timing, trajectory, and spin delivered to the ball member, and impact location of the ball member on the racket.

4. The head and rod assembly for a tennis ball training system of claim 3 wherein the at least one optical sensor assembly, the at least one three-axis impact sensor assembly, the at least one flex sensor assembly and at least one result calculated for at least one or more of the racket hit power, accuracy, timing, trajectory, and spin delivered to the ball member are used to statistically calculate the probable location of impact of the ball member on the racket.

5. The head and rod assembly for a tennis ball training system of claim 3 wherein the at least one optical sensor assembly, the at least one three-axis impact sensor assembly, the at least one flex sensor assembly, and the at least one algorithm used to calculate at least one or more of the racket hit power, accuracy, timing, trajectory, and spin delivered to the ball member, and the impact location of the ball member on the racket are operationally conveyed to at least one or more of a virtual reality or augmented reality system from at least one or more from a group of: screens, goggles, glasses, and contact lenses, wherein at least the user sees a virtual flight of an outgoing virtual ball member after hitting the ball member with the racket.

6. The head and rod assembly for a tennis ball training system of claim 5 wherein the at least one optical sensor assembly, the at least one three-axis impact sensor assembly, the at least one flex sensor assembly, and the at least one algorithm are further adapted to cue an at least one incoming virtual ball member wherein the virtual ball member optically overlays the ball member when the user should hit the ball member with the racket.

7. The head and rod assembly for a tennis ball training system of claim 3 wherein two or more load cells are adapted to provide data to calculate the impact location of the ball member on the racket.

8. The head and rod assembly for a tennis ball training system of claim 3 wherein audio signals are adapted to provide spin feedback, delivering a representative sound indicating whether a hit of the ball member by the racket was successful.

9. The head and rod assembly for a tennis ball training system of claim 3 wherein light signals are adapted to provide spin feedback, delivering at least one or more of colors and patterns to at least one or more of signal an action to take and communicate a result of the action.

10. The head and rod assembly for a tennis ball training system of claim 3 wherein the data and calculations by the algorithm are further adapted for scoring in one or more games adapted for the user to compete with at least one or more of other users and other scores.

11. A bendable shaft assembly and a head assembly of a tennis ball training system comprising:

a vertical polymer flexible rod assembly coupled at a top end of the vertical polymer flexible rod assembly to a distal surface of a ball cup member by a retaining plate member, the retaining plate member having a concave portion on a proximal face of the retaining plate member adapted, when coupled to the distal surface of the ball cup member, to secure the head assembly to the top end of the vertical polymer flexible rod assembly, the ball cup member adapted to hold a ball member; at least one flex sensor assembly adapted to detect bending of the polymer flexible rod assembly;

a ribbon wire member disposed longitudinally along a length of the vertical polymer flexible rod assembly and a metal base plate member, the ribbon wire member electrically coupled to a power source at a bottom portion of the ribbon wire member, a top portion of the ribbon wire member coupled to an electrical coupling member on a distal surface of the ball cup member, the top portion of the ribbon wire member disposed to substantially abut the proximal face of the retaining plate member; a top portion of the metal base plate member coupled by two or more helically threaded attachment members, the helically threaded attachment members disposed through two or more hole members disposed through the metal base plate member, to the vertical polymer flexible rod assembly and a back plate member, the helically threaded attachment members disposed through one or more attachment hole members disposed through a bottom portion of the vertical polymer flexible rod assembly and coupled to a corresponding two or more threaded hole members of the back plate member, an upper portion of the vertical flexible polymer rod member adapted to oscillate from racket impact energy imparted on the ball cup member; and at least one base hole member on a bottom portion of the base plate member adapted to be aligned with at least one pin member and attachment hole member of a substantially hollow vertical sleeve member of a stand assembly.

12. The bendable shaft assembly and a head assembly of a tennis ball training system of claim 11 wherein a light member used to signal a hitting action to a user is shut off before the user should hit the ball member, the sought time for the user to hit the ball member corresponding to when the vertical polymer flexible rod assembly is substantially straight, the straightness determined by the flex sensor.

13. The bendable shaft assembly and a head assembly of a tennis ball training system of claim 11 wherein flex sensor data and at least one algorithm are adapted to provide to a computer system at least one variable from which to operationally convey when the user should hit the ball member to at least one or more of a virtual reality or augmented reality system from at least one or more from a group of: screens, goggles, glasses, and contact lenses, wherein at least the user sees a virtual flight of an incoming virtual ball member that will optically overlay the ball member when the vertical polymer flexible rod member is substantially straight.

14. A method of using a head assembly and a bendable shaft assembly for a tennis ball training system for a user, the method comprising:

selecting a training program from a computer system, the computer system operationally coupled to a head assembly, a bendable shaft assembly, at least one optical sensor assembly, at least one three-axis impact sensor assembly, and at least one flex sensor assembly, the training program selected from at least one or more of learning, practice, and competition; selecting a skill from at least one or more from a group of time, repetition, ball speed, ball delivery, the skill quality developed from at least one or more from a group of power, accuracy, timing, trajectory, spin, and location of ball impact on a racket; selecting the start of a training session and beginning the training session; hitting with the racket a ball member held by the head assembly, the success of each hit determined by the at least one optical sensor assembly, at least one three-axis impact sensor assembly, and at least one flex sensor assembly;

the training session following substantially two tracks for evaluated action, a first track if the at least one or more from a group of power, accuracy, timing, trajectory, spin, and location of ball member impact on the racket metrics indicate hit success and a second track if the at least one or more from a group of power, accuracy, timing, trajectory, spin, and location of ball member impact on the racket metrics indicate hit failure; successful hits leading toward completing a training program; failed hits leading toward adjusting at least one or more of the training program, skill, and skill quality, the adjustment designed to foster the user achieving metrics of success; recording training program data; and, ending the training program session.

15. The method of using a head assembly and a bendable shaft assembly for a tennis ball training system for a user of claim 14, the method further including starting a warmup mode before starting the training session, the warmup measuring at least one or more of the skill quality developed from at least one or more from a group of hit power, accuracy, timing, trajectory, spin, and location of ball member impact on the racket.

16. The method of using a head assembly and a bendable shaft assembly for a tennis ball training system for a user of claim 15, the method further including selecting warmup time, ball dynamics, and at least one or more of predictable and unpredictable hit requirements.

17. The method of using a head assembly and a bendable shaft assembly for a tennis ball training system for a user of claim 14, the at least one flex sensor assembly detecting bending of the polymer flexible rod assembly, the bend providing data for at least partially determining the timing for hitting the ball member.

18. The method of using a head assembly and a bendable shaft assembly for a tennis ball training system for a user of claim 14, the at least one three-axis impact sensor assembly disposed in an interior portion of the ball cup member detecting trajectory forces imparted on the ball member when the racket impacts the ball member, the forces imparted on the ball member determining the skill quality of at least one or more from a group of power, accuracy, timing, trajectory, spin, and the location of impact on the racket.

19. The method of using a head assembly and a bendable shaft assembly for a tennis ball training system for a user of claim 14, the method further including the sensor data and at least one algorithm calculating at least one or more of racket hit power, accuracy, timing, trajectory, and spin delivered to the ball member and racket impact location of the ball member, the calculations operationally conveyed to at least one or more of a virtual reality and an augmented reality system from at least one or more from a group of: screens, goggles, glasses, and contact lenses, wherein at least the user sees a virtual flight of an outgoing virtual ball member after hitting the ball member with the racket.

20. The method of using a head assembly and a bendable shaft assembly for a tennis ball training system for a user of claim 19, the method further including the sensor data and at least one algorithm calculations cuing an at least one incoming virtual ball member wherein the incoming ball member optically overlays the ball member when the user should hit the ball member with the racket.

* * * * *